United States Patent [19]

Hufnagl

[11] Patent Number: 4,722,703

[45] Date of Patent: Feb. 2, 1988

[54] BUS BAR CONNECTOR

[75] Inventor: Arnold F. Hufnagl, Toronto, Canada

[73] Assignee: Electrolyser Inc., Toronto, Canada

[21] Appl. No.: 10,763

[22] Filed: Feb. 4, 1987

[30] Foreign Application Priority Data

Feb. 12, 1986 [CA] Canada ..... 501742

[51] Int. Cl.[4] ..... H01R 4/44

[52] U.S. Cl. ..... 439/781; 439/815; 439/210

[58] Field of Search ..... 339/242, 244, 245, 246, 339/247, 248, 249, 263 E, 265 R, 268 R, 272, 198 N, 22 R, 22 B

[56] References Cited

U.S. PATENT DOCUMENTS

| | | | |
|---|---|---|---|
| 946,434 | 1/1910 | Hartenstein | 339/265 R |
| 2,963,537 | 12/1960 | Carlson et al. | 339/22 B |
| 3,565,783 | 2/1971 | Emery et al. | 204/267 |
| 3,733,575 | 5/1973 | Gottschalk et al. | 339/22 B |
| 3,884,541 | 5/1975 | O'Nan et al. | 339/22 B |
| 4,281,227 | 7/1981 | Rexroad et al. | 339/273 R |
| 4,362,352 | 12/1982 | Hawkins et al. | 339/273 S |
| 4,581,306 | 4/1986 | Hasenauer et al. | 439/815 |
| 4,627,680 | 12/1986 | Weimer et al. | 439/210 |

FOREIGN PATENT DOCUMENTS

| | | | |
|---|---|---|---|
| 403076 | 6/1969 | Australia | 339/22 B |
| 691358 | 7/1964 | Canada . | |
| 311290 | 3/1919 | Fed. Rep. of Germany | 339/242 |
| 0113887 | 9/1979 | Japan | 339/22 B |
| 1392607 | 4/1975 | United Kingdom | 339/22 B |

OTHER PUBLICATIONS

"Industrial Water Electrolysis: Present & Future, R. L. LeRoy, 83, Int. J. Hydrogen Energy, vol. 18, No. 6, pp. 401–417.

*Primary Examiner*—Gil Weidenfeld
*Assistant Examiner*—Paula A. Austin
*Attorney, Agent, or Firm*—Fleit, Jacobson, Cohn & Price

[57] ABSTRACT

A bus bar connector for electrically connecting a number of aligned bus bar terminals to a similar number of aligned bus bar terminals is disclosed. The bus bar connector comprises at least one current conducting plate extending transversally across the bus bar terminals, and means for clamping such plate to the bus bar terminals.

5 Claims, 4 Drawing Figures

BUS BAR CONNECTOR

This invention relates to a bus bar connector for electrically interconnecting a number of aligned bus bar terminals to a similar number of aligned bus bar terminals, and more particularly to a bus bar connector for electrically connecting the bus bar terminals of an electrolytic cell to the terminals of an adjacent cell, or for connecting together two sections of high-current bus bars in an electrolytic plant.

Electrolytic plants, such as unipolar water electrolysis plants, commonly comprise a plurality of individual cells connected in series across a single power source. Thus the anode terminals of one cell are connected to the cathode terminals of an adjacent cell through an intercell bus bar connector. The intercell bus bar connectors used in water electrolysers normally carry a very high current and they are generally made of heavy copper bars in order to minimize voltage losses across the connectors. An example of such bus bar connectors is shown in FIG. 13 of an article entitled "Industrial Water Electrolysis: Present and Future" by R. L. LeRoy, published in the Int. J. Hydrogen Energy, Vol. 8, No. 6, pp 401–417, 1983. Other examples of such bus bar connectors may be found in Canadian Pat. No. 691,358 and U.S. Pat. No. 3,565,783.

The above bus bar connectors are generally made of individual units of heavy copper bars which are bolted to the terminals of the cells. As there is usually a large number of anode and cathode electrodes per cell and generally two connectors per electrode, interconnection of the cells is therefore labor intensive. In addition, in order to allow workers to move in between the cells to install the bus bar connectors, a minimum distance of about twenty inches is required between the electrolytic cells and this results in lost space in a plant containing several hundreds of individual cells connected in series. Furthermore, the use of individual connectors, from the anodes of one cell to the cathodes of the next cell limits equalization of current among all the electrodes because the distribution of current flow is dependent on each individual connector. This may compromise the overall electrolyser efficiency.

It is therefore the object of the present invention to provide a new bus bar connector for interconnecting a number of aligned bus bar terminals to a similar number of aligned bus bar terminals.

The bus bar connector, in accordance with the present invention, comprises at least one current conducting plate extending transversally across the bus bar terminals and means for clamping such plate to the bus bar terminals.

The clamping means preferably comprise two backing members, such as U-shaped channels, and bolts inserted through aligned holes drilled in the plate or plates and backing members. The bolts are preferably welded to one of the backing members so as to allow the connector to be handled as a single piece, and thus to facilitate assembly of the connector to the terminals.

The plates are made of conductive material such as copper and the backing members are preferably made of steel.

The invention will now be disclosed, by way of example, with reference to the accompanying drawings in which.

Figure 1:
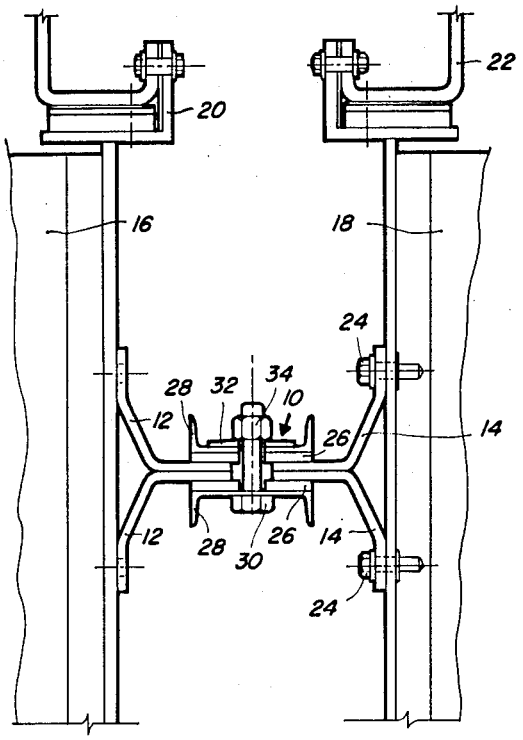
FIG. 1 illustrates an end sectional view of a bus bar connector in accordance with the invention.
Figure 2:
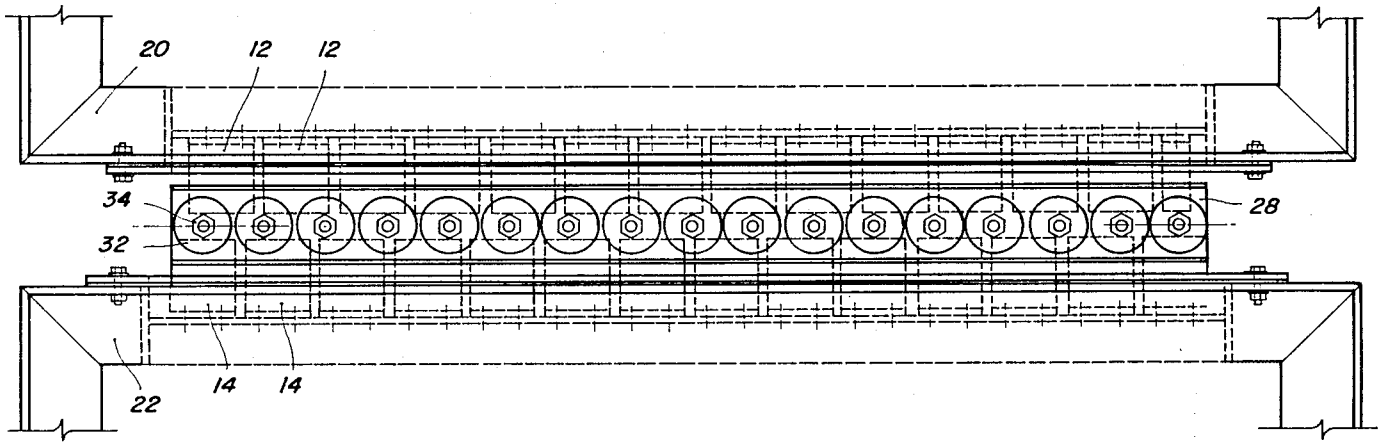
FIG. 2 is a plan view of the bus bar connector shown in FIG. 1, illustrating the transversal coverage of the clamp with respect to the bus bar terminals.

Referring to FIGS. 1 and 2, there is shown a bus bar connector identified generally by reference numeral 10 interconnecting the bus bar terminals 12 and 14 of the anodes 16 and cathodes 18, respectively, of adjacent cells 20 and 22. The bus bars terminals 12 and 14 are made of good current conductive material, such as copper. They are shown as being secured to the side of the electrodes by bolts 24 passing through the wall of the cells. However, it is to be understood that the bus bar terminals could be otherwise secured to the electrodes by methods such as brazing, soldering or welding. There are generally two sets of vertically spaced bus bar terminals per electrode although there may be more or less than two depending on the height of the electrodes.

Each bus bar connector comprises two elongated bars 26 extending transversally across all the bus bar terminals one below and one above the terminals. The bars 26 are made of a good current conductive material such as copper. Two U-shaped channels 28 preferably made of steel are used as backing members to clamp the bars 26 across the bus bar terminals. It is to be understood that other types of backing members can be used. The bars 26 and channels 28 are provided with a plurality of spaced holes and the copper bars are clamped across the bus bar terminals by means of bolts 30 extending through such holes. A large Belleville or other spring washer 32 is preferably located underneath the nut 34 of each bolt to provide a sustained clamping force which is distributed across the clamped surfaces by the channels 28. The heads of the bolts 30 are also preferably welded to one of the U-shaped channels to facilitate installation of the bus bar connector across the bus bar terminals. The U-shaped steel channels may be electroplated with a protective metal to provide protection against corrosion.

Prior to installation of the bus bar connector, the copper bars 26 are sandwiched between the two U-shaped steel channels and the nuts threaded on the bolts but not tightened. Welding of the heads of the bolts on one of the channel simplifies the assembly operation although the bolts may be inserted through the plates and channels one by one. The connector is then inserted across the bus bar terminals 12 and 14 with one copper bar above and the other below the terminals. The bolts 30 slide in a gap which is provided between the terminals of the cells and once in position can be tightened using an appropriate ratchet wrench. It will be noted that this operation does not require the workers to move in between the cells for assembling the connector. Consequently, the cells can be placed at about six inches from each other, thus cutting down the space requirement which is substantial in a plant containing several hundreds of cells. More importantly, the new bus bar connector reduces substantially the number of components required to make the connection between two cells. In the example shown in FIG. 2, one connector replaces the 28 individual connecting bars (one per terminal) which were previously required for each row of terminals. It will also be noted that only 17 bolts need be tightened to secure the connector whereas 56 bolts (4 per connecting bar) were previously needed. Thus, in using the connector of this invention, only one piece must be handled, in place of 28 connector bars and their nuts, bolts and washers. The above connector thereby cuts down the number of hours required to connect and disconnect the cells and therefore the labor cost and any interruption of production. Furthermore, the new bus bar connector allows even distribution of current among the different electrodes as the distribution of current is not limited to individual connectors.

It has been found that the above bus bar connector provides good clamping of the bus bar terminals. This is partly due to the differential coefficient of expansion between copper which is normally used for the bus bars 12, 14 and 26, and steel which is normally used for the clamping channels 28. Upon heating from room temperature to the operating temperature (about 70° C.) copper which is normally used for the bus bar expands more than steel which is normally used for the channels and bolts, and this causes an additional clamping action on the terminals.

Figure 3:
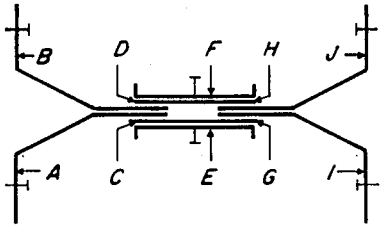
FIGS. 3 and 4 illustrate various points of the bus bar connectors of FIG. 1 wherein probes can be positioned for measuring the voltage drop and temperature across the connector during normal operation.
Figure 4:
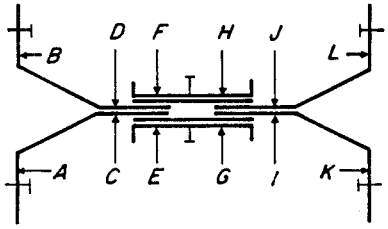

Ohmic drop and thermal mapping measurements of the intercell connector were done at the front, the middle and the back of the cells. The cell voltage during the test was 1.888 volt and the average temperature of the cells 70.7° C. The measurements were made at a current load of 100 KA and 55 KA. The results of the above tests are given in the following Tables 1 and 2 which should be read in conjunction with FIGS. 3 and 4, respectively, which show the location of the measurement points.

TABLE I

| VOLTAGE DROP OF BUS BAR CONNECTOR (mV) | | | |
|---|---|---|---|
| | Front | Middle | Back |
| A | 0(0) | 0(0) | 0(0) |
| B | 9.4(1.7)* | 2.1(2.8) | 1.2(2.5) |
| C | 10.2(3.2) | 4.3(2.7) | 5.9(3.3) |
| D | 6.3(3.1) | 3.5(2.2) | 6.4(3.1) |
| E | 12.6(5.1) | 9.0(5.2) | —(4.9) |
| F | 12.9(5.0) | 7.2(5.2) | —(4.6) |
| G | 13.6(6.6) | 12.2(7.7) | 7(5.6) |
| H | 15.0(6.6) | 14.1(8.2) | 7.4(6.4) |
| I | 20.2(9.4) | 17.8(11.3) | —(10.8) |
| J | 20.2(10.4) | 19.8(12.2) | —(11.1) |

*number in brackets is for current load of 55 KA

TABLE 2

| TEMPERATURE OF BUS BAR CONNECTOR (°C.) | | | |
|---|---|---|---|
| | Front | Middle | Back |
| A | 65(59)* | 71(65) | 71(63) |
| B | 64(64) | 75(64) | 70(65) |
| C | 70(58) | 74(64) | 74(65) |
| D | 73(63) | 75(68) | —(—) |
| E | 71(61) | 69(—) | 70(58) |

TABLE 2-continued

| TEMPERATURE OF BUS BAR CONNECTOR (°C.) | | | |
|---|---|---|---|
| | Front | Middle | Back |
| F | 70(58) | 74(60) | 71(59) |
| G | 69(56) | 71(—) | 68(56) |
| H | 70(58) | 73(61) | 72(60) |
| I | 70(61) | 75(—) | 76(63) |
| J | 74(64) | 75(64) | 74(61) |
| K | 69(60) | 72(58) | —(54) |
| L | 70(62) | 75(65) | 73(63) |

*number in brackets is for current load of 55 KA

The results of the above tests give a low voltage drop of about 20 mV across the bus bar terminal and connector at 100 KA and of about 10 mV at 55 KA. The maximum surface temperature at various locations on the bus bar terminal and connector was about 75° C. and there was no local overheating of the connector.

Although the invention has been disclosed with reference to the interconnection of the electrode terminals of electrolytic cells, it is to be understood that the bus bar connector has other applications and may be used in any application where a number of aligned terminals need to be connected to a similar number of aligned terminals. One example is used as an off-load switch for connecting together or separating sections of high-current d.c. bus bar. It is also to be understood that each bus bar terminal may consist of one or more unitary or laminated bus bars. Similarly, the number of current conducting plates (unitary or laminated) may vary, the only limitation being that the current carrying capacity of the plate or plates be comparable to the current carrying capacity of the bus bar terminal. When a single current conducting plate is used on one side of the bus bar terminals, the backing number located on the other side of the terminals will engage the bus bar directly.

What is claimed is:

1. A bus bar connector for electrically connecting a number of aligned bus bar terminals to a similar number of aligned bus bar terminals comprising:

(a) at least one current conducting plate extending transversally across the bus bar terminals, and (b) means for clamping said plate to the bus bar terminals.

2. A bus bar connector as defined in claim 1, wherein each bus bar terminal consists of a set of two bus bars and wherein two current conducting plates are placed one below and one above the terminals.

3. A bus bar connector as defined in claim 1, wherein said clamping means comprises two backing members and bolts inserted through aligned holes drilled in said plate and backing members.

4. A bus bar connector as defined in claim 3, wherein the heads of said bolts are welded to one of the backing members.

5. A bus bar connector as defined in claim 3, wherein said plate is made of copper and said backing members are made of steel.

* * * * *